US011045692B2

(12) United States Patent
Madson

(10) Patent No.: US 11,045,692 B2
(45) Date of Patent: Jun. 29, 2021

(54) DIMPLE PATTERNS FOR GOLF BALLS

(71) Applicant: Acushnet Company, Fairhaven, MA (US)

(72) Inventor: Michael R. Madson, Easton, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 16/587,298

(22) Filed: Sep. 30, 2019

(65) Prior Publication Data

US 2021/0093925 A1 Apr. 1, 2021

(51) Int. Cl.
*A63B 37/14* (2006.01)
*A63B 37/00* (2006.01)

(52) U.S. Cl.
CPC ..... *A63B 37/0006* (2013.01); *A63B 37/0012* (2013.01); *A63B 37/0021* (2013.01); *A63B 37/002* (2013.01)

(58) Field of Classification Search
CPC ..... A63B 37/0006
USPC ..... 446/378–385
See application file for complete search history.

(56) References Cited

U.S. PATENT DOCUMENTS 5,072,945 A * 12/1991 Oka ..... A63B 37/0021 473/384
5,090,705 A * 2/1992 Oka ..... A63B 37/0004 473/384
5,145,180 A * 9/1992 Oka ..... A63B 37/0004 40/327
5,441,276 A * 8/1995 Lim ..... A63B 37/0006 473/378
5,544,890 A * 8/1996 Shaw ..... A63B 37/0018 473/383
5,564,708 A * 10/1996 Hwang ..... A63B 37/0004 473/382
5,709,618 A * 1/1998 Hwang ..... A63B 37/0004 473/382
5,735,756 A * 4/1998 Stiefel ..... A63B 37/0004 473/382
5,759,116 A 6/1998 Kasasima et al.
5,890,974 A 4/1999 Stiefel et al.
6,213,898 B1 * 4/2001 Ogg ..... A63B 37/0004 473/383
6,224,499 B1 * 5/2001 Ogg ..... A63B 37/0004 473/383
6,331,150 B1 12/2001 Ogg
6,482,110 B2 * 11/2002 Ogg ..... A63B 37/0004 473/383
6,511,389 B2 * 1/2003 Ogg ..... A63B 37/0004 473/383
6,540,625 B2 4/2003 Sajima
6,551,203 B2 * 4/2003 Ogg ..... A63B 37/0004 473/383
6,609,983 B2 * 8/2003 Winfield ..... A63B 37/0004 473/378
7,267,624 B2 * 9/2007 Tapper ..... A63B 37/0004 473/383

(Continued)

*Primary Examiner* — Eugene L Kim
*Assistant Examiner* — Matthew B Stanczak
(74) *Attorney, Agent, or Firm* — Mandi M. Milbank

(57) ABSTRACT

A golf ball dimple pattern based on a square dipyramid, i.e., two square pyramids connected base-to-base, is disclosed. The dimples are arranged within four substantially identical triangular sections on each of two substantially identical hemispheres of the ball.

18 Claims, 10 Drawing Sheets

(56) References Cited

U.S. PATENT DOCUMENTS 7,691,010 B2 * 4/2010 Ohama ..... A63B 37/0006 473/383
9,975,004 B2 * 5/2018 Sajima ..... A63B 37/0077
2002/0019274 A1 * 2/2002 Sajima ..... A63B 37/0018 473/378
2002/0032081 A1 * 3/2002 Ogg ..... A63B 37/0075 473/378
2002/0034990 A1 * 3/2002 Sajima ..... A63B 37/0017 473/378
2002/0165043 A1 * 11/2002 Winfield ..... A63B 37/0021 473/378
2003/0008729 A1 * 1/2003 Sajima ..... A63B 37/0016 473/378
2003/0045378 A1 * 3/2003 Bissonnette ..... A63B 37/0012 473/378
2003/0119606 A1 * 6/2003 Ohama ..... A63B 37/0003 473/371
2004/0157682 A1 * 8/2004 Morgan ..... A63B 37/0006 473/378
2005/0037871 A1 * 2/2005 Nardacci ..... A63B 37/0021 473/378
2005/0137032 A1 * 6/2005 Aoyama ..... A63B 37/0004 473/378
2006/0025240 A1 * 2/2006 Endo ..... A63B 37/0033 473/371
2006/0025243 A1 * 2/2006 Tapper ..... A63B 37/0021 473/378
2007/0049423 A1 * 3/2007 Nardacci ..... A63B 37/0089 473/378
2007/0298908 A1 * 12/2007 Sajima ..... A63B 37/0004 473/384
2008/0045360 A1 * 2/2008 Ohama ..... A63B 37/0004 473/384
2009/0247326 A1 * 10/2009 Ohama ..... A63B 37/0024 473/377
2010/0190584 A1 * 7/2010 Sajima ..... A63B 37/002 473/384
2010/0240473 A1 * 9/2010 Aoyama ..... A63B 37/0019 473/384
2015/0031476 A1 * 1/2015 Hwang ..... A63B 37/0004 473/383
2015/0182802 A1 * 7/2015 Madson ..... A63B 37/0006 473/378
2018/0161630 A1 * 6/2018 Aoyama ..... A63B 37/002
2018/0161631 A1 * 6/2018 Aoyama ..... A63B 37/0074
2019/0070465 A1 * 3/2019 Hwang ..... A63B 37/002

* cited by examiner

DIMPLE PATTERNS FOR GOLF BALLS

FIELD OF THE INVENTION

The present invention relates to golf ball dimple patterns based on a square dipyramid, wherein the dimples are arranged within four substantially identical triangular sections on each of the two hemispheres of the ball.

BACKGROUND OF THE INVENTION

Golf ball manufacturers make substantial efforts to maximize the aerodynamic efficiency of golf balls, though they are closely controlled by golf's national governing body, the United States Golf Association (U.S.G.A.). One U.S.G.A. requirement is that golf balls have aerodynamic symmetry. Aerodynamic symmetry allows the ball to fly with a very small amount of variation no matter how the golf ball is placed on the tee or ground. In order to improve aerodynamic symmetry, many dimple patterns are based, for example, on geometric shapes, the five Platonic Solids, and the thirteen Archimedean Solids. Because the number of symmetric solid plane systems useful in designing dimple patterns is limited, it can be difficult to devise new symmetric patterns. Moreover, dimple patterns based on some geometric shapes result in less than optimal surface coverage and other disadvantageous dimple arrangements.

Thus, there is a continuing need for novel dimple patterns incorporating unique combinations of dimple properties such as size, shape, number, volume, or arrangement, in order to provide a golf ball that has distinctive characteristics.

SUMMARY OF THE INVENTION

The present invention is directed to a golf ball having a plurality of dimples arranged in a pattern defined by a square dipyramid projected on the spherical outer surface of the ball. The plurality of dimples comprises at least three different dimple diameters, including a minimum dimple diameter, a maximum dimple diameter, and at least one additional dimple diameter. The golf ball consists of two hemispheres separated by an equator. The two hemispheres have substantially identical dimple arrangements. Each hemispherical dimple arrangement consists of four triangular sections that are defined by projecting the four faces of a square pyramid onto the hemisphere, such that each of the four triangular sections is defined by a border consisting of a linear equatorial edge which corresponds to a portion of the equator of the ball and two linear side edges connecting each end of the equatorial edge to a pole of the ball. The four triangular sections of each hemisphere are substantially identical in size and dimple arrangement. The dimple arrangement within each of the four triangular sections optionally includes a shared polar dimple having a centroid that lies at the vertex of the two side edges of the section. The diameter of the shared polar dimple, if present, is not the minimum dimple diameter or the maximum dimple diameter. The dimple arrangement within each of the four triangular sections is not rotationally symmetric about the center of the section. Each of the four triangular sections can be divided into a polar region, an intermediate region, and an equatorial region. The polar region is the area of the triangular section from latitude angle 0° to latitude angle 30°, with latitude angle 0° being the pole. The intermediate region is the area of the triangular section from latitude angle 30° to latitude angle 60°. The equatorial region is the area of the triangular section from latitude angle 60° to latitude angle 90°, with latitude angle 90° being the equator. The polar region includes at least one non-polar dimple having the minimum dimple diameter and does not include a dimple having the maximum dimple diameter. The intermediate region includes at least one dimple having the minimum dimple diameter and at least one dimple having the maximum dimple diameter. The equatorial region includes at least one dimple having the maximum dimple diameter and does not include a dimple having the minimum dimple diameter. In a particular embodiment, the intermediate region includes at least one dimple having the minimum dimple diameter. In another particular embodiment, the intermediate region includes at least one dimple having the maximum dimple diameter. In another particular embodiment, the intermediate region includes at least one dimple having the minimum dimple diameter and at least one dimple having the maximum dimple diameter.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION

A square pyramid is a polyhedron formed by connecting each of the four vertices of a square base to an apex. The resulting solid consists of the square base and four triangular faces that are equal in size, and has five vertices, including the four vertices of the square base and the apex. Each of the four triangular faces has two side edges and a base edge. Adjacent faces have a common side edge. Thus, a square pyramid has eight linear edges, including four side edges and four base edges.

A square dipyramid is a polyhedron formed from two square pyramids joined at their bases. The resulting solid consists of eight triangular faces that are equal in size, and has six vertices, including four vertices of the base at which the two square pyramids are joined and the apex of each of the two square pyramids. Each of the eight triangular faces has two side edges and a base edge. Adjacent faces on the same side of the square dipyramid have a common side edge, and adjacent faces on opposite sides of the square dipyramid have a common base edge. Thus, a square dipyramid has twelve linear edges, including eight side edges and four base edges.

Figure 1:
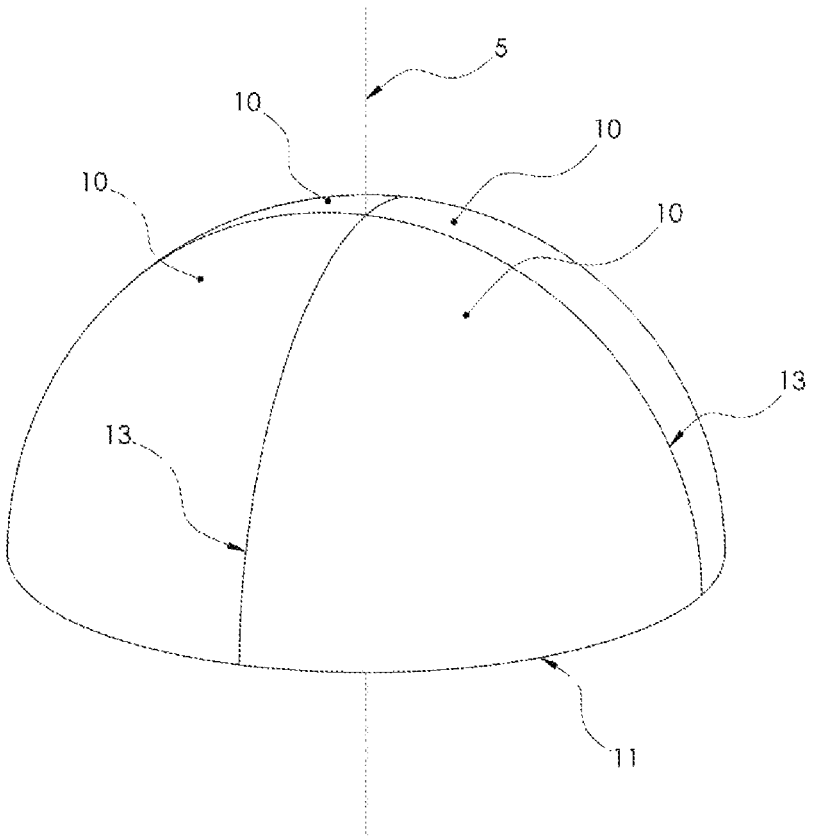
FIG. 1 illustrates four faces of a square pyramid projected onto a hemisphere.

Golf ball dimple patterns of the present invention are based on a square dipyramid. As shown in FIG. 1, each hemisphere of the ball consists of four triangular dimple sections 10 defined by projecting the four faces of a square pyramid onto the hemisphere. Each of the four triangular dimple sections is defined by a border consisting of two linear side edges 13 and a linear equatorial edge 11 corresponding to the side edges and the base edge of a face of the square pyramid. Thus, the two hemispheres of the ball correspond to two square pyramids joined at their bases to form a square dipyramid projected onto the spherical outer surface of a golf ball. Each base edge of the square dipyramid, when projected onto the spherical outer surface of the ball, corresponds to a portion of the equator of the ball. Each of the two apexes of the square dipyramid, when projected onto the spherical outer surface of the ball, corresponds to a pole of the ball.

The two hemispheres of the ball have substantially identical dimple arrangements. For purposes of the present disclosure, dimple arrangements are substantially identical if the relative positions of their dimples' centroids are about the same, as would be understood by one of ordinary skill in the art. The overall dimple pattern on the golf ball may have a rotational offset between the two hemispheres of up to 45°.

The dimple arrangement within each of the four triangular dimple sections on each of the two hemispheres of the ball is substantially identical. For purposes of the present disclosure, the triangular section within which a dimple is located is determined based on the location of the centroid of the dimple. Thus, each dimple on the ball is said to be located in a single dimple section, other than dimples having a centroid that is located along a side edge or an equatorial edge.

Dimples having a centroid that is located along an edge are referred to herein as shared dimples. A shared dimple whose centroid lies on a side edge, but does not lie at one of the two apexes of the dipyramid or at one of the four vertices of the base at which the two square pyramids are joined, is referred to herein as a side edge dimple. Thus, side edge dimples are shared between adjacent sections of one hemisphere that have a common side edge on which the centroid of the side edge dimple lies. A shared dimple whose centroid lies on an equatorial edge, but does not lie at one of the four vertices of the base at which the two square pyramids are joined, is referred to herein as a shared equatorial dimple. Thus, shared equatorial dimples are shared between adjacent sections of different hemispheres that have a common equatorial edge on which the centroid of the shared equatorial dimple lies. A shared dimple whose centroid lies at an apex, i.e., a single point shared by the four sections of one hemisphere and corresponding to the pole, is referred to herein as a polar dimple. Thus, polar dimples are shared between the four sections of the hemisphere containing the pole on which the centroid lies. A shared dimple whose centroid lies at one of the four vertices of the base at which the two square pyramids are joined is referred to herein as a base vertex dimple. Thus, base vertex dimples are shared between four sections, including two adjacent sections of one hemisphere that have common equatorial edges with two adjacent sections of the other hemisphere.

Dimples of the present invention are either a shared dimple or a non-shared dimple. Thus, non-shared dimples of the present invention are dimples having a centroid that is not located along an edge. Non-shared dimples of the present invention include dimples having a perimeter that is not intersected by any edge, referred to herein as non-intersected dimples, and dimples having a perimeter that is intersected by an equatorial edge but not a side edge, referred to herein as non-shared equatorial dimples. Dimple patterns of the present invention do not include non-shared dimples having a perimeter that is intersected by a side edge.

The dimple arrangement within each of the triangular sections comprises a plurality of non-intersected dimples, and, optionally, one or more of the following: a polar dimple, one or more side edge dimples, one or more non-shared equatorial dimples, one or more shared equatorial dimples, or one or more base vertex dimples.

In a particular embodiment of the present invention, the dimple arrangement within each of the triangular sections consists of a plurality of non-intersected dimples, at least one side edge dimple, at least one non-shared equatorial dimple, and, optionally, a polar dimple. In a particular aspect of this embodiment, there are no dimple free great circles on the outer surface of the ball. In other words, in this particular aspect, every great circle on the outer surface of the ball intersects at least one dimple.

In another particular embodiment of the present invention, the dimple arrangement within each of the triangular sections consists of a plurality of non-intersected dimples, at least one non-shared equatorial dimple, and, optionally, a polar dimple. In a particular aspect of this embodiment, the triangular section includes a polar dimple, and there are no dimple free great circles on the outer surface of the ball. In another particular aspect of this embodiment, the triangular section does not include a polar dimple, and the outer surface of the ball has two dimple free great circles defined by the side edges of the triangular sections.

In another particular embodiment of the present invention, the dimple arrangement within each of the triangular sections consists of a plurality of non-intersected dimples, at least one side edge dimple, and, optionally, a polar dimple. In a particular aspect of this embodiment, the outer surface of the ball has a dimple free great circle corresponding to the equator.

In another particular embodiment of the present invention, the dimple arrangement within each of the triangular sections consists of a plurality of non-intersected dimples. In a particular aspect of this embodiment, the outer surface of the ball has a dimple free great circle corresponding to the equator and two dimple free great circles defined by the side edges of the triangular sections.

Referring again to FIG. 1, the dimple arrangement within each of the four triangular dimple sections 10 is substantially identical, such that the dimple arrangement on each hemisphere of the ball has four-way rotational symmetry about a polar axis 5. Thus, for each non-shared dimple located within a particular triangular dimple section, there is a corresponding non-shared dimple in each of the other three dimple sections of that hemisphere. For dimple patterns of the present invention that include side edge dimples, for each side edge dimple having a centroid located along a particular side edge, there is a corresponding side edge dimple located along each of the other three side edges of that hemisphere. For dimple patterns of the present invention that include shared equatorial dimples, for each shared equatorial dimple having a centroid located along a particular equatorial edge, there is a corresponding shared equatorial dimple located along each of the other three equatorial edges. For dimple patterns of the present invention that include polar dimples, a polar dimple on one hemisphere has a corresponding polar dimple on the other hemisphere. For dimple patterns of the present invention that include base vertex dimples, for each base vertex dimple having a centroid located at a particular vertex of the base at which the two square pyramids are joined, there is a corresponding base vertex dimple located at each of the other three base vertices. For each set of corresponding dimples, the relative positions of the dimple centroids within their respective sections are about the same, and, in a particular embodiment, each of the dimples within that set of corresponding dimples has substantially the same dimple characteristics e.g., plan shape, cross-sectional shape, diameter, edge angle, etc.).

The dimple arrangement within each of the triangular sections is not rotationally symmetric about the center of the section.

Figure 2:
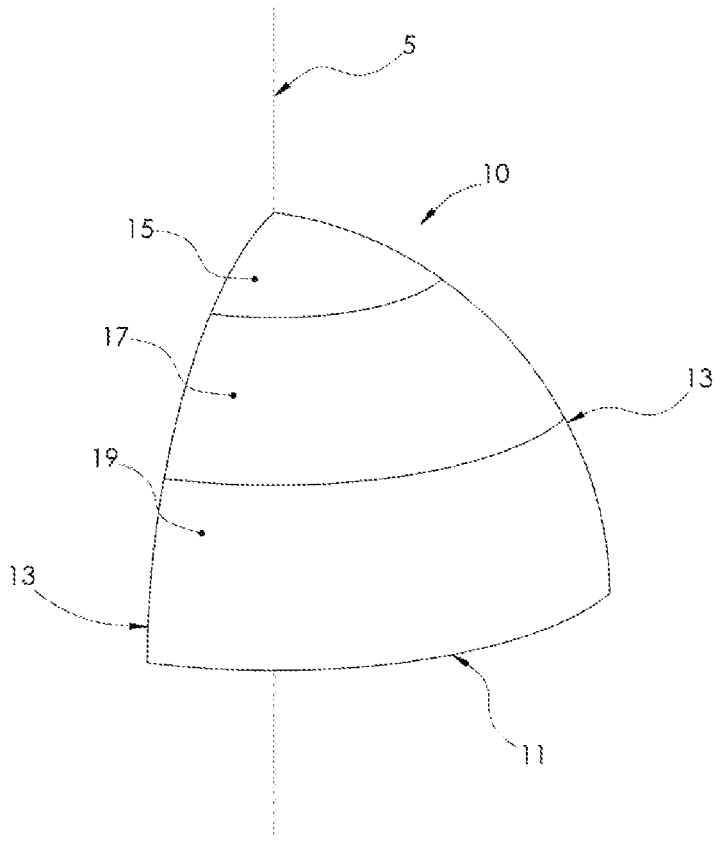
FIG. 2 illustrates one of the four faces of FIG. 1 divided into three regions.

Each of the triangular sections can be divided into three regions: a polar region, an intermediate region, and an equatorial region. The polar region is the area of the triangular section from latitude angle 0° to latitude angle 30°. The intermediate region is the area of the triangular section from latitude angle 30° to latitude angle 60°. The equatorial region is the area of the triangular section from latitude angle 60° to latitude angle 90°. Latitude angle 0° is the pole. Latitude angle 90° is the equator. For example, FIG. 2 shows one of the triangular dimple sections 10 of FIG. 1. The triangular section is divided into a polar region 15, an intermediate region 17, and an equatorial region 19.

The region within which a dimple is located is determined based on the location of the centroid of the dimple. For purposes of the present disclosure, dimples having a centroid located at latitude angle 30° are defined as being within the intermediate region, and dimples having a centroid located at latitude angle 60° are defined as being within the equatorial region.

Each triangular section includes at least three different dimple diameters, including a maximum dimple diameter, a minimum dimple diameter, and at least one additional dimple diameter. Preferably, in dimple patterns of the present invention wherein a polar dimple is present, the polar dimple does not have the minimum dimple diameter. Dimple patterns of the present invention also have one or more of the following properties:

a) the polar region of each triangular section includes at least one dimple that has the minimum dimple diameter and is not a polar dimple, and, optionally, the latitude angle of at least one non-polar dimple located in the polar region and having the minimum dimple diameter is less than 20°;
b) the polar region of each triangular section does not include a dimple having the maximum dimple diameter;
c) the equatorial region of each triangular section includes at least one dimple having the maximum dimple diameter;
d) the equatorial region of each triangular section does not include a dimple having the minimum dimple diameter;
e) the intermediate region of each triangular section includes at least one dimple having the minimum dimple diameter; and
f) the intermediate region of each triangular section includes at least one dimple having the maximum dimple diameter.

It should be understood that manufacturing variances are to be taken into account when determining the number of different dimple diameters. For purposes of the present disclosure, dimples having substantially the same diameter, also referred to herein as "same diameter" dimples, includes dimples on a finished ball having respective diameters that differ by less than 0.005 inches due to manufacturing variances.

Dimple patterns of the present invention optionally have one or pore of the following additional properties:

a) there is a polar dimple;
b) there is no polar dimple;
c) each triangular section includes at least four, or at least five, different dimple diameters;
d) within each triangular section, the number of different dimple diameters located in the intermediate region is greater than the number of different dimple diameters located in the polar region and greater than the number of different dimple diameters located in the equatorial region;
e) within each triangular section, the number of different dimple diameters located in the polar region is equal to the number of different dimple diameters located in the equatorial region;
f) the total number of dimples having the minimum dimple diameter is greater than the number of dimples having the maximum dimple diameter;
g) the total number of dimples having the minimum dimple diameter is less than the number of dimples having the maximum dimple diameter;
h) there are no dimple free great circles on the outer surface of the ball;
i) the outer surface of the ball has a dimple free great circle corresponding to the equator; and
j) the outer surface of the ball has a dimple free great circle corresponding to the equator and two dimple free great circles defined by the side edges of the triangular sections.

Dimples of the present invention are not limited to a particular plan shape or profile shape. Particularly suitable plan shapes include, but are not limited to, circular, polygonal, oval, and irregular shapes. Particularly suitable profile shapes include, but are not limited to, circular, catenary, elliptical, and conical shapes.

Figure 3:
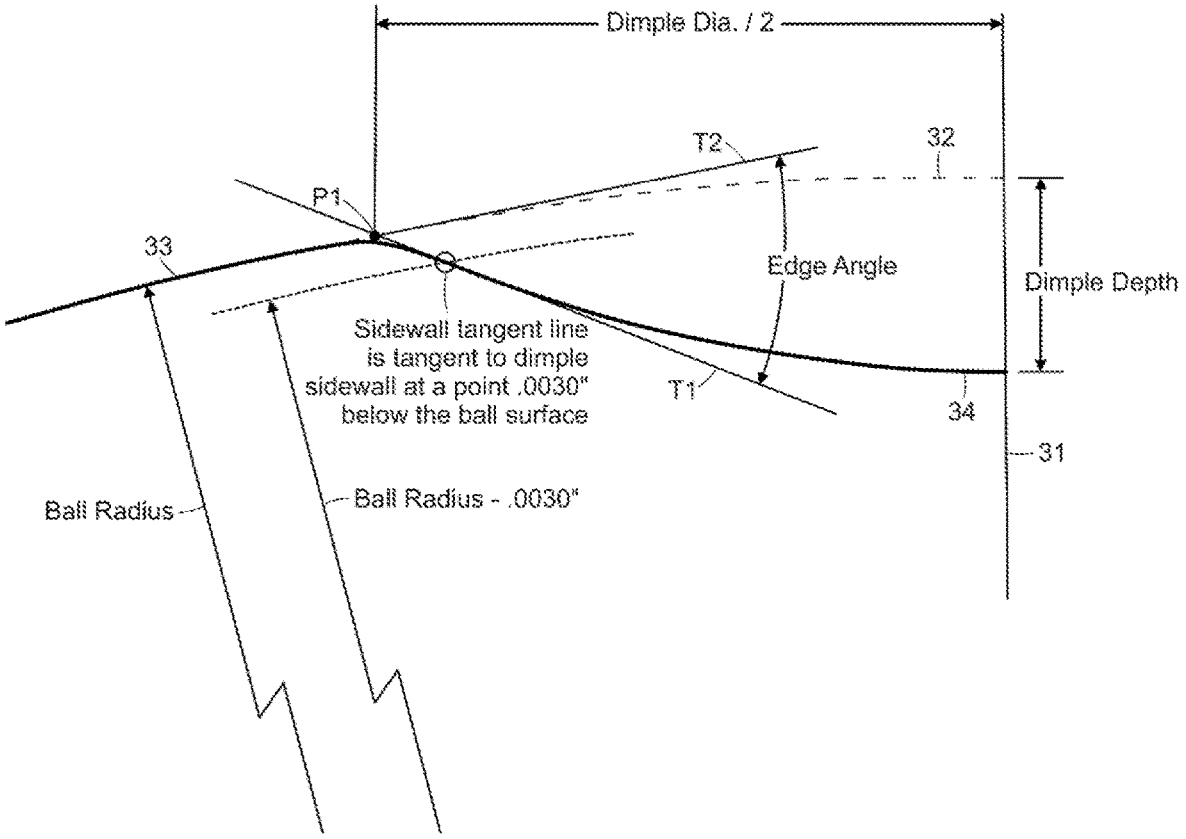
FIG. 3 is a schematic diagram illustrating a method for measuring the diameter of a dimple.

Each dimple on the outer surface of the ball preferably has a diameter of 0.050 or 0.060 or 0.070 or 0.080 or 0.090 or 0.100 or 0.110 or 0.120 or 0.130 or 0.150 or 0.160 or 0.170 or 0.180 or 0.190 or 0.200 or 0.205 or 0.210 or 0.220 or 0.250 inches or a diameter within a range having a lower limit and an upper limit selected from these values. In a particular embodiment, the maximum difference between any two dimple diameters on the ball is less than 0.055 inches. The diameter of a dimple having a non-circular plan shape is defined by its equivalent diameter, $d_e$, which calculated as:

$$d_e = 2\sqrt{\frac{A}{\pi}}$$

where A is the plan shape area of the dimple. Diameter measurements are determined on finished golf balls according to FIG. 3. Generally, it may be difficult to measure a dimple's diameter due to the indistinct nature of the boundary dividing the dimple from the ball's undisturbed land surface. Due to the effect of paint and/or the dimple design itself, the junction between the land surface and dimple may not be a sharp corner and is therefore indistinct. This can make the measurement of a dimple's diameter somewhat ambiguous. To resolve this problem, dimple diameter on a finished golf ball is measured according to the method shown in FIG. 3. FIG. 3 shows a dimple half-profile 34, extending from the dimple centerline 31 to the land surface outside of the dimple 33. A ball phantom surface 32 is constructed above the dimple as a continuation of the land surface 33. A first tangent line T1 is then constructed at a point on the dimple sidewall that is spaced 0.003 inches radially inward from the phantom surface 32. T1 intersects phantom surface 32 at a point P1, which defines a nominal dimple edge position. A second tangent line T2 is then constructed, tangent to the phantom surface 32, at P1. The edge angle is the angle between T1 and T2. The dimple diameter is the distance between P1 and its equivalent point diametrically opposite along the dimple perimeter. Alternatively, it is twice the distance between P1 and the dimple centerline 31, measured in a direction perpendicular to centerline 31. The dimple depth is the distance measured along a ball radius from the phantom surface of the ball to the deepest point on the dimple. The dimple volume is the space enclosed between the phantom surface 32 and the dimple surface 34 (extended along T1 until it intersects the phantom surface).

In a particular embodiment, a majority of the dimples on the outer surface of golf balls of the present invention are spherical dimples, i.e., dimples having a circular plan shape and a profile shape based on a spherical function. In a particular aspect of this embodiment, the spherical dimples have one or more properties/characteristics selected from:

a) the edge angle of each spherical dimple is 10° or 11° or 12° or 13° or 14° or 15° or 16°, or is within a range having a lower limit and an upper limit selected from these values;

b) the maximum difference in edge angle between any two of the spherical dimples is 1°; and c) the edge angle of all of the spherical dimples is substantially the same (For purposes of the present disclosure, edge angles on a finished ball are substantially the same if they differ by less than 0.25°.).

Preferably, none of the dimples on the outer surface of the ball overlap or touch.

Dimple patterns generated by the present invention are capable of achieving a high percentage of surface coverage. In a particular embodiment, the present invention generates a surface coverage of about 75% or greater. In another particular embodiment, the present invention generates a surface coverage of about 78% or greater.

The total number of dimples on the golf ball is preferably an even number between about 250 and about 500. In a particular embodiment, the total number of dimples is 320 or 322 or 328 or 330 or 336 or 338 or 344 or 346 or 352 or 354 or 360 or 362 or 368 or 370 or the total number of dimples is within a range having a lower limit and an upper limit selected from these values.

Golf balls of the present invention are not limited by a particular golf ball construction. The golf ball may have any type of core, such as solid, liquid, wound, and the like, and may be a one-piece, two-piece, or multilayer ball. Each layer of the golf ball may be constructed from any suitable thermoset or thermoplastic material known to those of ordinary skill in the art. When desirable, the cover may be coated with any number of layers, such as a base coat, top coat, paint, or any other desired coating. As will be appreciated by those skilled in the art, any manufacturing technique may be used to construct the various portions of the golf ball. In a particular embodiment, the golf ball is a multilayer ball comprising a solid, single layer core, an inner cover layer, and an outer cover layer. In a particular aspect of this embodiment, the core is formed from a thermoset rubber, the inner cover layer is formed from an ionomer composition, and the outer cover layer is formed from a polyurethane composition.

EXAMPLES

The following non-limiting examples demonstrate dimple patterns of golf balls made in accordance with the present invention. The examples are merely illustrative of the preferred embodiments of the present invention, and are not to be construed as limiting the invention, the scope of which is defined by the appended claims.

Non-Limiting Exemplary Dimple Pattern 1

Figure 4A:
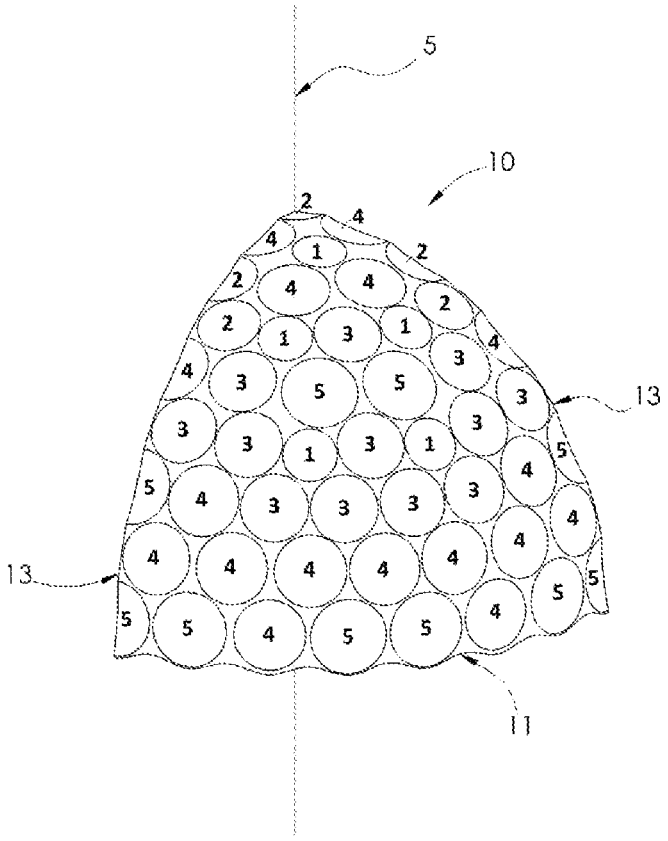
FIGS. 4A-4C illustrate the face of FIG. 2 with dimples arranged therein according to an embodiment of the present invention.
Figure 4B:
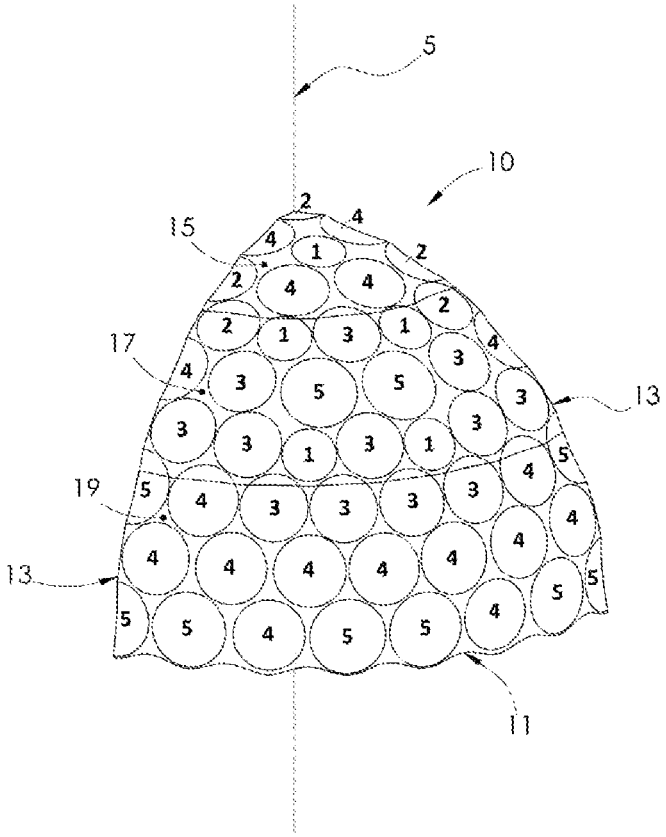
Figure 4C:
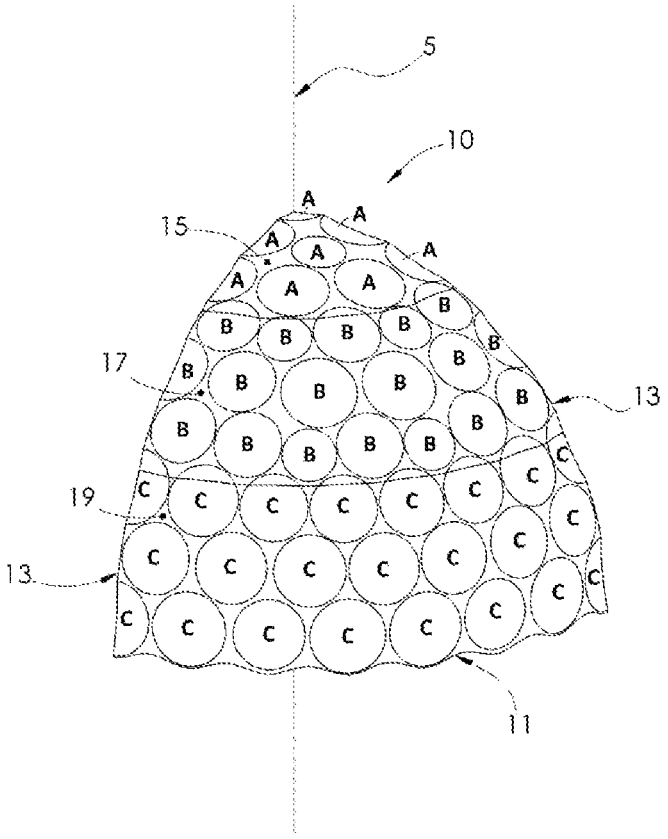

A triangular section of a dimple pattern based on a square dipyramid according to a particular embodiment of the present invention is illustrated in FIGS. 4A-4C. FIGS. 4A-4C show a triangular dimple section 10 packed with dimples into a dimple arrangement consisting of: thirty-two non-intersecting dimples, one polar dimple, ten side edge dimples, and six non-shared equatorial dimples. Thus, a golf ball having a dimple pattern based on a square dipyramid, with each triangular dimple section having the dimple arrangement shown in FIGS. 4A-4C, has a total of 346 dimples, with a surface coverage of about 82.1%. The golf ball has a non-planar parting line that is defined by a drawing a non-linear segment 11 along the path of each equatorial edge. To provide for dimples in the pattern whose perimeters are intersected by an equatorial edge, the dimple pattern has a rotational offset between the two hemispheres of about 45°. There are no dimple free great circles on the outer surface of the ball.

In FIGS. 4A-4B, the numerical labels within the dimples designate same diameter dimples; i.e., all dimples labelled 1 have substantially the same diameter, all dimples labelled 2 have substantially the same diameter, and so on. In a particular aspect of the embodiment illustrated in FIGS. 4A-4C, same diameter dimples also have substantially the same chord depth and substantially the same edge angle. In a further particular aspect of the embodiment illustrated in FIGS. 4A-4C, the dimples labelled 1-5 have the diameters given in Table 1 below:

TABLE 1

| Numerical Label | Dimple Diameter (inches) |
|---|---|
| 1 | 0.128 |
| 2 | 0.150 |
| 3 | 0.160 |
| 4 | 0.170 |
| 5 | 0.180 |

Thus, according to the embodiment shown in FIGS. 4A-4B, and wherein the dimples have properties according to Table 1, the dimples have a total of five different dimple diameters, including a minimum dimple diameter of 0.128 inches and a maximum dimple diameter of 0.180. The total number of dimples on the ball having the minimum dimple diameter is forty, and the total number of dimples on the ball having the maximum dimple diameter is sixty-four.

FIGS. 4B & 4C show lines drawn at latitude angle 30° and latitude angle 60° thereby dividing the triangular dimple section 10 into a polar region 15, an intermediate region 17, and an equatorial region 19. In FIG. 4C, the alphabetical labels within the dimples designate the region in which the dimple is located; i.e., all dimples labelled A are located in the polar region 15, all dimples labelled B are located in the intermediate region 17, and all dimples labelled C are located in the equatorial region 19.

Thus, according to the embodiment shown in FIGS. 4A-4C, and wherein the dimples have properties according to Table 1, the triangular dimple section 10 has the following properties:

a) the polar region 15 includes one dimple that has the minimum dimple diameter, the latitude angle of which is about 15°;
b) the polar region 15 does not include a dimple having the maximum dimple diameter;
C) the intermediate region 17 includes four dimples having the minimum dimple diameter;
d) the intermediate region 17 includes two dimples having the maximum dimple diameter;
e) the equatorial region 19 includes eight dimples having the maximum dimple diameter, including four non-shared equatorial dimples and four side edge dimples;
f) the equatorial region 19 does not include a dimple having the minimum dimple diameter; and
g) the intermediate region 17 includes five different dimple diameters, the polar region 15 includes three different diameters, and the equatorial region 19 includes three different diameters; thus, the number of different dimple diameters located in the intermediate region 17 is greater than the number of different dimple diameters located in the polar region 15 and greater than the number of different dimple diameters located in the equatorial region 19, and the number of different dimple diameters located in the polar region 15 is equal to the number of different dimple diameters located in the equatorial region 19.

Non-Limiting Exemplary Dimple Pattern 2

Figure 5A:
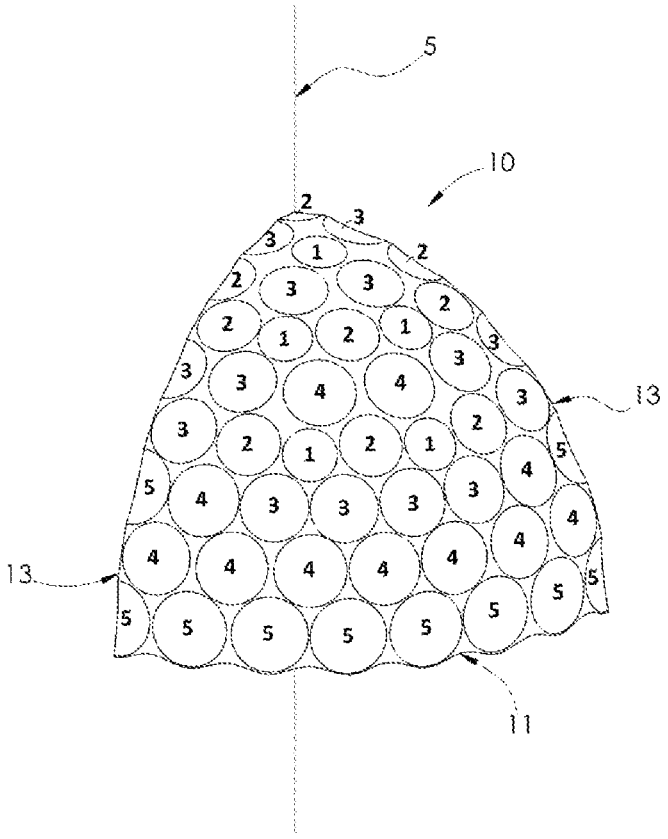
FIGS. 5A-5C illustrate the face of FIG. 2 with dimples arranged therein according to an embodiment of the present invention.
Figure 5B:
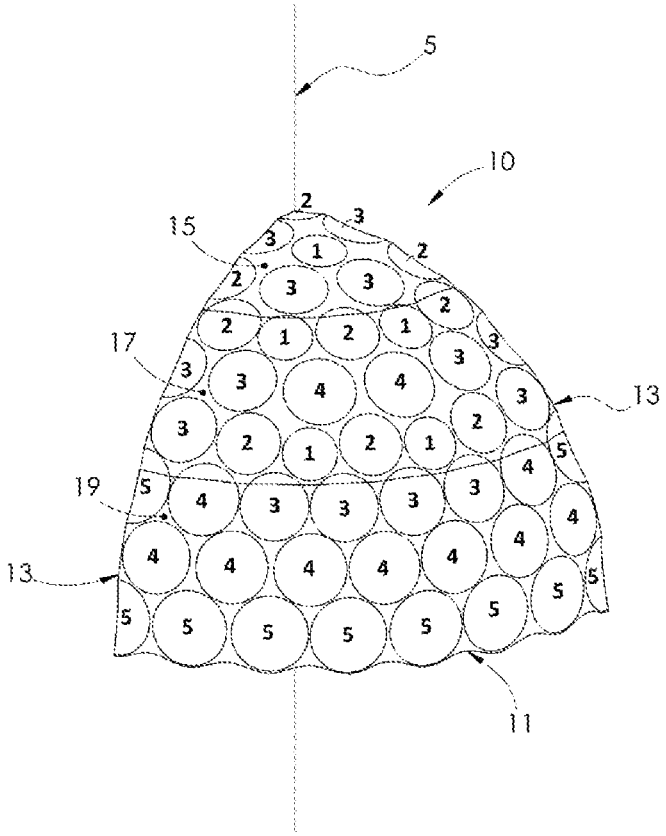
Figure 5C:
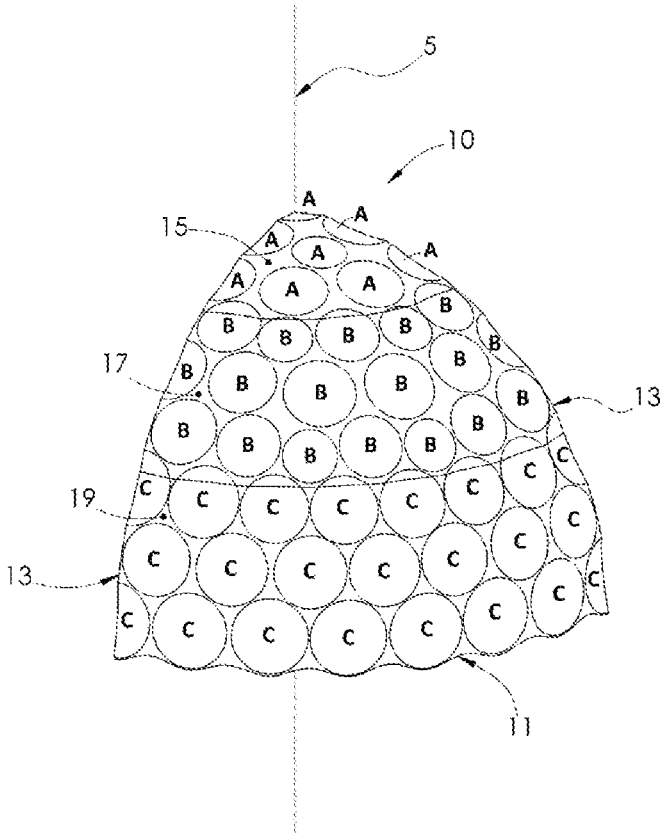
Figure 5D:
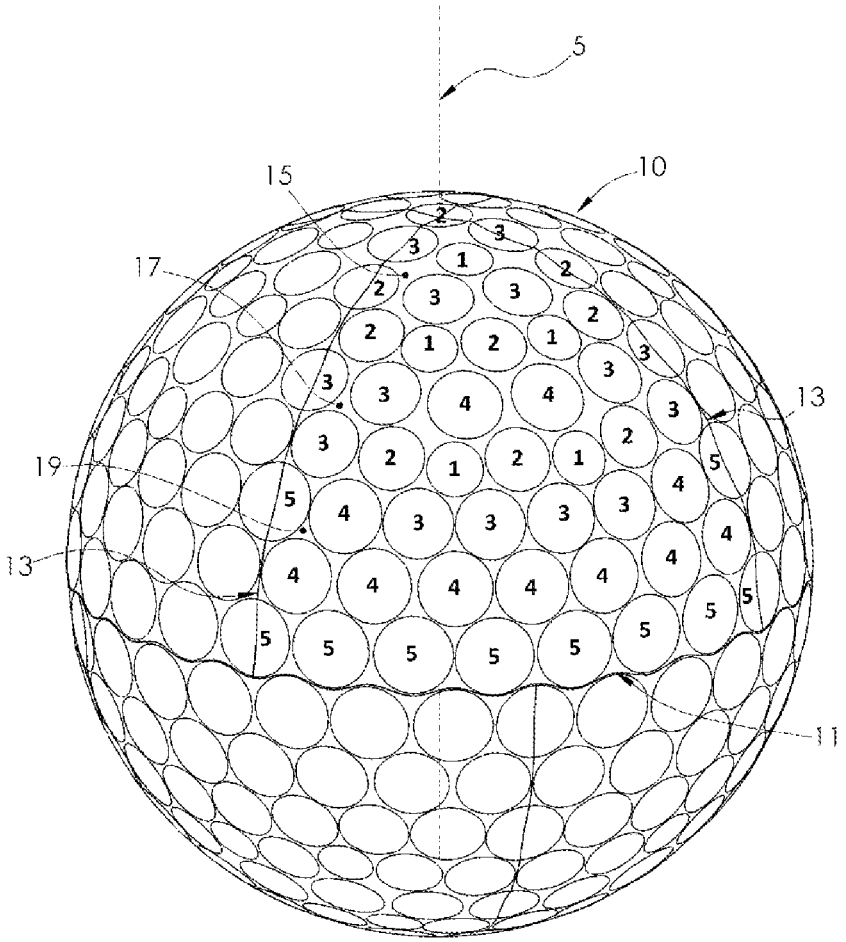
FIG. 5D illustrates a golf ball having a dimple pattern according to an embodiment of the present invention.

A triangular section of a dimple pattern based on a square dipyramid according to a particular embodiment of the present invention is illustrated in FIGS. 5A-5C. FIGS. 5A-5C show a triangular dimple section 10 packed with dimples into a dimple arrangement consisting of: thirty-two non-intersecting dimples, one polar dimple, ten side edge dimples, and six non-shared equatorial dimples. Thus, a golf ball having a dimple pattern based on a square di pyramid, with each triangular dimple section having the dimple arrangement shown in FIGS. 5A-5C, is illustrated in FIG. 5D, and has a total of 346 dimples, with a surface coverage of about 80.3%. The golf ball has a non-planar parting line that is defined by a drawing a non-linear segment 11 along the path of each equatorial edge. To provide for dimples in the pattern whose perimeters are intersected by an equatorial edge, the dimple pattern has a rotational offset between the two hemispheres of about 45°. There are no dimple free great circles on the outer surface of the ball.

In FIGS. 5A-5B, the numerical labels within the dimples designate same diameter dimples; i.e., all dimples labelled 1 have substantially the same diameter, all dimples labelled 2 have substantially the same diameter, and so on. In a particular aspect of the embodiment illustrated in FIGS. 5A-5C, same diameter dimples also have substantially the same chord depth and substantially the same edge angle. In a further particular aspect of the embodiment illustrated in FIGS. 5A-5C, the dimples labelled 1-5 have the diameters given in Table 2 below:

TABLE 2

| Numerical Label | Dimple Diameter (inches) |
|---|---|
| 1 | 0.128 |
| 2 | 0.150 |
| 3 | 0.160 |

TABLE 2-continued

| Numerical Label | Dimple Diameter (inches) |
|---|---|
| 4 | 0.170 |
| 5 | 0.180 |

Thus, according to the embodiment shown in FIGS. SA-5B, and wherein the dimples have properties according to Table 2, the dimples have a total of five different dimple diameters, including a minimum dimple diameter of 0.128 inches and a maximum dimple diameter of 0.180. The total number of dimples on the ball having the minimum dimple diameter is forty, and the total number of dimples on the ball having the maximum dimple diameter is sixty-four.

FIGS. 5B & 5C show lines drawn at latitude angle 30° and latitude angle 60° thereby dividing the triangular dimple section 10 into a polar region 15, an intermediate region 17, and an equatorial region 19. In FIG. 5C, the alphabetical labels within the dimples designate the region in which the dimple is located; i.e., all dimples labelled A are located in the polar region 15, all dimples labelled B are located in the intermediate region 17, and all dimples labelled C are located in the equatorial region 19.

Thus, according to the embodiment shown in FIGS. 5A-5C, and wherein the dimples have properties according to Table 2, the triangular dimple section 10 has the following properties:

a) the polar region 15 includes one dimple that has the minimum dimple diameter, the latitude angle of which is about 15°;
b) the polar region 15 does not include a dimple having the maximum dimple diameter;
c) the intermediate region 17 includes four dimples having the minimum dimple diameter;
d) the intermediate region 17 does not include a dimple having the maximum dimple diameter;
e) the equatorial region 19 includes ten dimples having the maximum dimple diameter, including six non-shared equatorial dimples and four side edge dimples;
f) the equatorial region 19 does not include a dimple having the minimum dimple diameter; and
g) the intermediate region 17 includes four different dimple diameters, the polar region 15 includes three different diameters, and the equatorial region 19 includes three different diameters; thus, the number of different dimple diameters located in the intermediate region 17 is greater than the number of different dimple diameters located in the polar region 15 and greater than the number of different dimple diameters located in the equatorial region 19, and the number of different dimple diameters located in the polar region 15 is equal to the number of different dimple diameters located in the equatorial region 19.

When numerical lower limits and numerical upper limits are set forth herein, it is contemplated that any combination of these values may be used.

All patents, publications, test procedures, and other references cited herein, including priority documents, are fully incorporated by reference to the extent such disclosure is not inconsistent with this invention and for all jurisdictions in which such incorporation is permitted.

While the illustrative embodiments of the invention have been described with particularity, it will be understood that various other modifications will be apparent to and can be readily made by those of ordinary skill in the art without departing from the spirit and scope of the invention. Accordingly, it is not intended that the scope of the claims appended hereto be limited to the examples and descriptions set forth herein, but rather that the claims be construed as encompassing all of the features of patentable novelty which reside in the present invention, including all features which would be treated as equivalents thereof by those of ordinary skill in the art to which the invention pertains.

What is claimed is:

1. A golf ball having a plurality of dimples disposed on the spherical outer surface thereof, wherein:

the plurality of dimples comprises at least three different dimple diameters, including a minimum dimple diameter, a maximum dimple diameter, and at least one additional dimple diameter;

the golf ball consists of two hemispheres separated by an equator, the two hemispheres having substantially identical dimple arrangements;

each hemispherical dimple arrangement consists of four triangular sections that are defined by projecting the four faces of a square pyramid onto the hemisphere such that each of the four triangular sections is defined by a border consisting of a linear equatorial edge which corresponds to a portion of the equator of the ball and two linear side edges connecting each end of the equatorial edge to a pole of the ball;

the four triangular sections of each hemisphere are substantially identical in size and dimple arrangement;

the dimple arrangement within each of the four triangular sections includes a shared polar dimple having a centroid that lies at the vertex of the two side edges of the section, where the diameter of the shared polar dimple is not the minimum dimple diameter or the maximum dimple diameter;

the dimple arrangement within each of the four triangular sections is not rotationally symmetric about the center of the section;

each of the four triangular sections can be divided into a polar region from latitude angle 0° to latitude angle 30°, an intermediate region from latitude angle 30° to latitude angle 60°, and an equatorial region from latitude angle 60° to latitude angle 90°, where latitude angle 0° is the pole and latitude angle 90° is the equator;

the polar region includes at least one non-polar dimple having the minimum dimple diameter and does not include a dimple having the maximum dimple diameter; and the equatorial region includes at least one dimple having the maximum dimple diameter and does not include a dimple having the minimum dimple diameter.

2. The golf ball of claim 1, wherein the intermediate region includes at least one dimple having the minimum dimple diameter.

3. The golf ball of claim 1, wherein the intermediate region does not include a dimple having the maximum dimple diameter.

4. The golf ball of claim 1, wherein the latitude angle of at least one dimple having the minimum dimple diameter is less than about 20°.

5. The golf ball of claim 1, wherein the plurality of dimples comprises at least five different dimple diameters; and wherein the number of different dimple diameters present in the intermediate region is greater than the number of different dimple diameters present in the polar region and greater than the number of different dimple diameters present in the equatorial region.

6. The golf ball of claim 5, wherein the number of different dimple diameters present in the polar region is equal to the number of different dimple diameters present in the equatorial region.

7. The golf ball of claim 1, wherein the number of dimples having the minimum dimple diameter is greater than the number of dimples having the maximum dimple diameter.

8. The golf ball of claim 1, wherein the number of dimples having the minimum dimple diameter is less than the number of dimples having the maximum dimple diameter.

9. The golf ball of claim 1, wherein there are no dimple free great circles on the outer surface of the ball.

10. The golf ball of claim 1, wherein the outer surface of the ball has a dimple free great circle corresponding to the equator.

11. A golf ball having a plurality of dimples disposed on the spherical outer surface thereof, wherein:

the plurality of dimples comprises at least three different dimple diameters, including a minimum dimple diameter, a maximum dimple diameter, and at least one additional dimple diameter;

the golf ball consists of two hemispheres separated by an equator, the two hemispheres having substantially identical dimple arrangements;

each hemispherical dimple arrangement consists of four triangular sections that are defined by projecting the four faces of a square pyramid onto the hemisphere such that each of the four triangular sections is defined by a border consisting of a linear equatorial edge which corresponds to a portion of the equator of the ball and two linear side edges connecting each end of the equatorial edge to a pole of the ball;

the four triangular sections of each hemisphere are substantially identical in size and dimple arrangement;

the dimple arrangement within each of the four triangular sections includes a shared polar dimple having a centroid that lies at the vertex of the two side edges of the section, where the diameter of the shared polar dimple is not the minimum dimple diameter or the maximum dimple diameter;

the dimple arrangement within each of the four triangular sections is not rotationally symmetric about the center of the section;

each of the four triangular sections can be divided into a polar region from latitude angle 0° to latitude angle 30°, an intermediate region from latitude angle 30° to latitude angle 60°, and an equatorial region from latitude angle 60° to latitude angle 90°, where latitude angle 0° is the pole and latitude angle 90° is the equator;

the polar region includes at least one non-polar dimple having the minimum dimple diameter and does not include a dimple having the maximum dimple diameter;

the intermediate region includes at least one dimple having the minimum dimple diameter and at least one dimple having the maximum dimple diameter;

the equatorial region includes at least one dimple having the maximum dimple diameter and does not include a dimple having the minimum dimple diameter.

12. The golf ball of claim 11, wherein the latitude angle of at least one dimple having the minimum dimple diameter is less than about 20°.

13. The golf ball of claim 11, wherein the plurality of dimples comprises at least five different dimple diameters; and wherein the number of different dimple diameters present in the intermediate region is greater than the number of different dimple diameters present in the polar region and greater than the number of different dimple diameters present in the equatorial region.

14. The golf ball of claim 13, wherein the number of different dimple diameters present in the polar region is equal to the number of different dimple diameters present in the equatorial region.

15. The golf ball of claim 11, wherein the number of dimples having the minimum dimple diameter is greater than the number of dimples having the maximum dimple diameter.

16. The golf ball of claim 11, wherein the number of dimples having the minimum dimple diameter is less than the number of dimples having the maximum dimple diameter.

17. The golf ball of claim 11, wherein there are no dimple free great circles on the outer surface of the ball.

18. The golf ball of claim 11, wherein the outer surface of the ball has a dimple free great circle corresponding to the equator.

* * * * *